US010845149B2

(12) United States Patent
Doerr et al.

(10) Patent No.: US 10,845,149 B2
(45) Date of Patent: Nov. 24, 2020

(54) SILENCER FOR GUN

(71) Applicants: John Anthony Doerr, Henderson, NV (US); Kyle Simmons, Henderson, NV (US)

(72) Inventors: John Anthony Doerr, Henderson, NV (US); Kyle Simmons, Henderson, NV (US)

( * ) Notice: Subject to any disclaimer, the term of this patent is extended or adjusted under 35 U.S.C. 154(b) by 0 days.

(21) Appl. No.: 16/297,236

(22) Filed: Mar. 8, 2019

(65) Prior Publication Data

US 2020/0284540 A1 Sep. 10, 2020

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4; 181/223
See application file for complete search history.

(56) References Cited

U.S. PATENT DOCUMENTS 3,667,570 A * 6/1972 WerBell, III ..... F41A 21/30 181/223
7,832,323 B1 * 11/2010 Davies ..... F41A 21/30 89/14.4
8,100,224 B1 1/2012 Olson
8,555,765 B2 * 10/2013 Graham, II ..... F41A 21/325 285/92
8,714,300 B2 * 5/2014 Johansen ..... F41A 21/325 181/223
9,194,640 B2 * 11/2015 Wirth ..... F41A 21/30
9,410,761 B2 * 8/2016 Morris ..... F41A 21/30
9,835,400 B2 12/2017 Barrett et al.
9,921,020 B2 * 3/2018 Latka ..... F41A 21/30
2011/0297477 A1 * 12/2011 Koumbis ..... F41A 21/30 181/223
2012/0180624 A1 * 7/2012 Troy ..... F41A 21/30 89/14.4
2012/0291614 A1 * 11/2012 Koumbis ..... F41A 21/30 89/14.4
2013/0133976 A1 * 5/2013 Johansen ..... F41A 21/30 181/223
2016/0109205 A1 * 4/2016 Coppinger ..... F41A 21/30 89/14.4
2018/0128566 A1 * 5/2018 Reis Green ..... F41A 21/30
2018/0202744 A1 * 7/2018 De Sousa ..... F41A 21/30
2019/0376758 A1 * 12/2019 Tiziani ..... F41A 21/30

OTHER PUBLICATIONS

SilencerCo—https://silencerco.com/silencers/hybrid/.
Griffin Armament—https://www.griffinarmament.com/optimus-silencer/.

* cited by examiner

*Primary Examiner* — Samir Abdosh
(74) *Attorney, Agent, or Firm* — Howard & Howard Attorneys PLLC

(57) ABSTRACT

A silencer for a gun includes an inner end housing adapted to be coupled to a gun, an outer end housing coupled to the inner end housing and defining an axial axis, a baffle holder disposed inside the inner end housing and the outer end housing, the baffle holder having at least two slots spaced axially along the axial axis, and at least two baffles disposed in the at least two slots of the baffle holder, one of the at least two baffles being disposed in one of the at least two slots, the at least two baffles having an aperture extending axially therethrough to allow a bullet fired from the gun to pass therethrough.

19 Claims, 6 Drawing Sheets

SILENCER FOR GUN

BACKGROUND OF THE INVENTION

1. Field of the Invention

The present invention relates generally to guns and, more particularly, to a silencer for a gun.

2. Description of the Related Art

It is known to provide a silencer for a gun. A silencer typically includes at least one baffle disposed within a cylindrical housing. The silencer may include a plurality of distal-facing conical baffles having a wider end and an opposing narrower end. The silencer may also include a plurality proximal-facing conical baffles intersected by distal-facing conical baffles such that the narrower end of the distal-facing conical baffle extends beyond a wider end of the proximal-facing baffle. The baffles generally include a central bore extending through both the distal-facing conical baffle and the proximal-facing conical baffle to allow a bullet to pass from the gun through the silencer.

Typical silencers cannot be dissembled for cleaning. Further, these silencers have a central bore of one caliber such that different silencers are needed for different caliber guns. In addition, these silencers include baffles that cannot be removed and replaced. Therefore, there is a need in the art to provide a silencer for a gun that can be disassembled for cleaning and include sets of baffles of different calibers that can be removed and replaced after cleaning.

SUMMARY OF THE INVENTION

The present invention provides a silencer for a gun including an inner end housing adapted to be coupled to a gun, an outer end housing coupled to the inner end housing and defining an axial axis, and a baffle holder disposed inside the inner end housing and the outer end housing. The baffle holder includes at least two slots spaced axially along the axial axis and at least two baffles disposed in the at least two slots of the baffle holder. One of the at least two baffles is disposed in one of the at least two slots. The at least two baffles include a central aperture extending axially therethrough to allow a bullet fired from the gun to pass therethrough.

One advantage of the present invention is that a new silencer is provided for a gun. Another advantage of the present invention is that the silencer can be disassembled for cleaning. Yet another advantage of the present invention is that the silencer has sets of baffles that vary in calibers dependent on the gun being used. Still another advantage of the present invention is that the silencer includes a baffle holder with removable baffles that fit into slots. A further advantage of the present invention is that the silencer includes a porthole in each baffle to reduce noise and is adaptable to fit multiple guns.

Other advantages and features of the present invention will be readily appreciated, as the same becomes better understood, by reference to the following detailed description when considered in connection with the accompanying drawings.

BRIEF DESCRIPTION OF THE DRAWINGS

Corresponding reference characters indicate corresponding components throughout the several views of the drawings.

DESCRIPTION OF THE PREFERRED EMBODIMENT(S)

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Figures 1, 2:
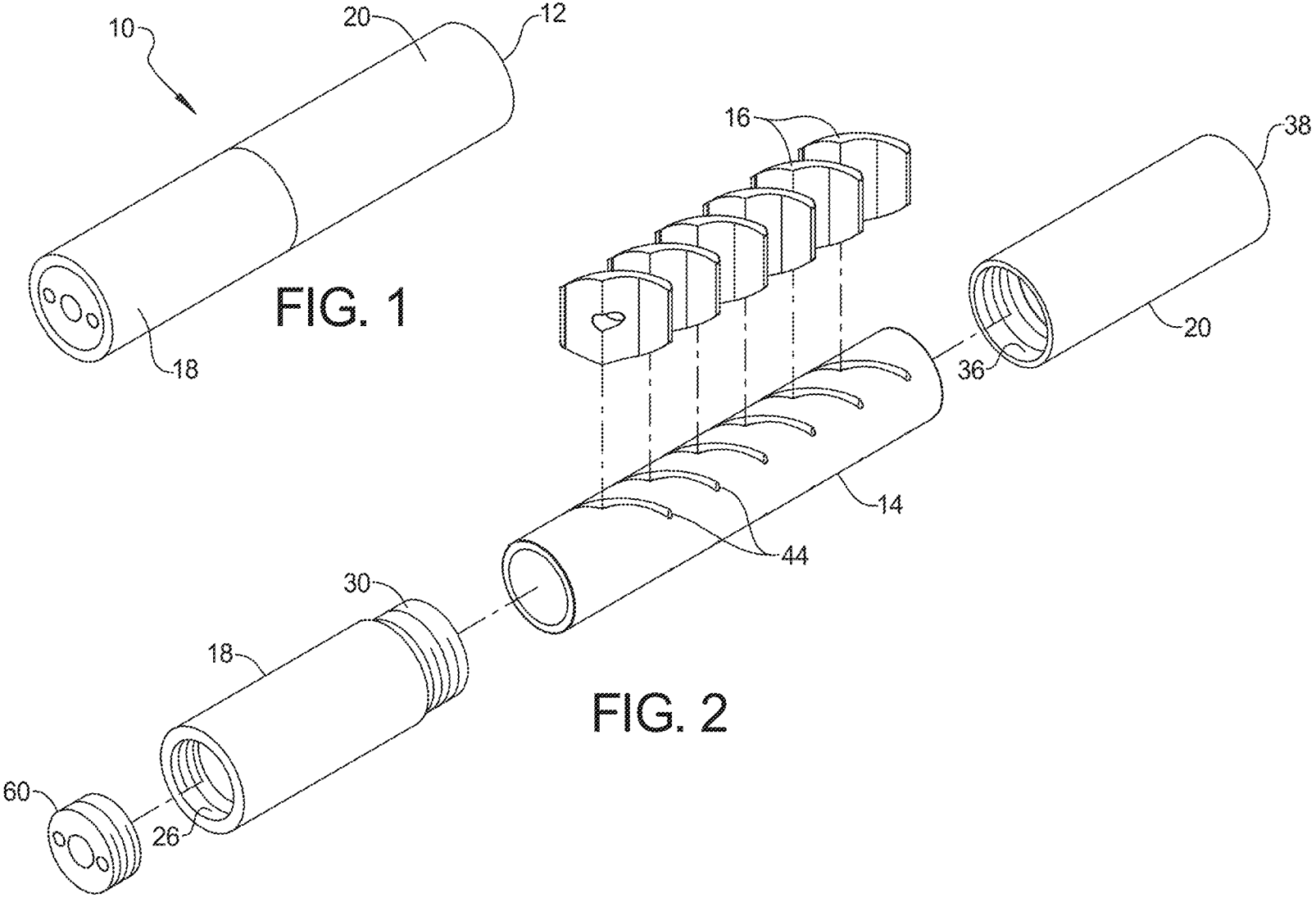
FIG. 1 is a perspective view of a silencer, according to the present invention, for a gun.
FIG. 2 is an exploded view of the silencer of FIG. 1.

Referring to FIGS. 1 and 2, in general, the present invention provides a silencer 10 for a gun such as a rifle (not shown). The silencer 10 includes a cylindrical housing 12 extending axially and coupled to the gun by a suitable mechanism to be described. The silencer 10 also includes a baffle holder 14 disposed inside the housing 12. The silencer 10 further includes a plurality of baffles 16 coupled to the baffle holder 14. It should be appreciated that the silencer 10 silences or reduces noise of a projectile or bullet (not shown) that is fired from the gun.

Figure 3:
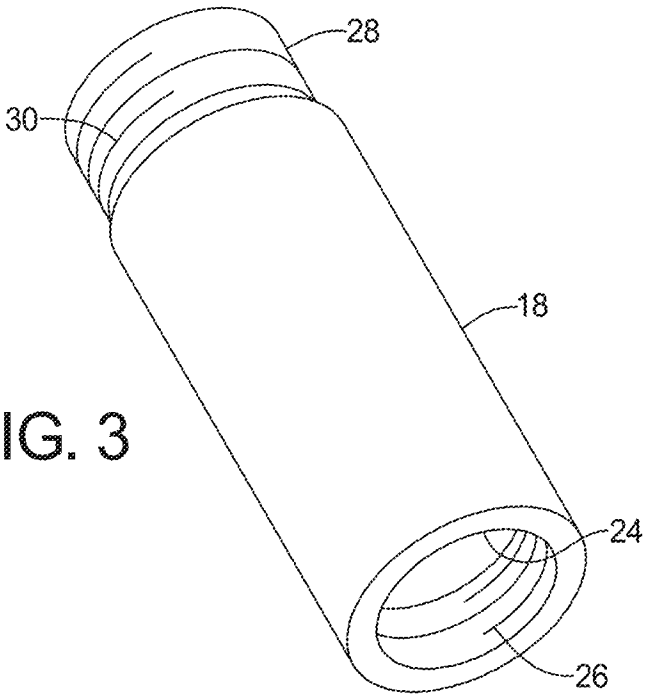
FIG. 3 is a perspective view of an inner end housing of the silencer of FIG. 2.
Figure 4:
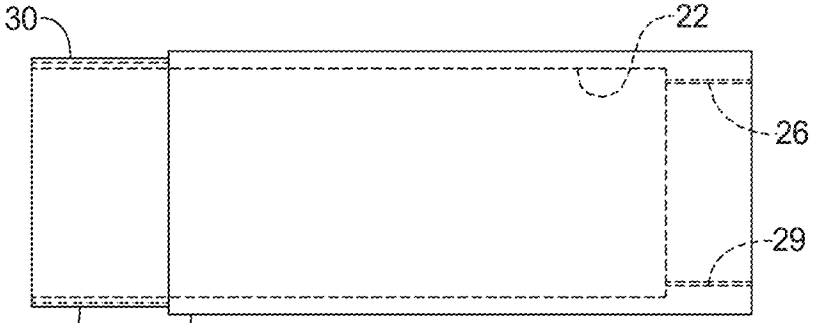
FIG. 4 is a front view of the inner end housing of FIG. 3.
Figure 5:
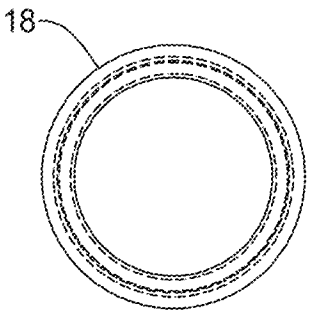
FIG. 5 is an end view of the inner end housing of FIG. 3.

In one embodiment, the housing 12 includes an inner end housing 18 coupled to the gun and an outer end housing 20 coupled to the inner end housing 18. As illustrated in FIGS. 3-5, the inner end housing 18 is generally cylindrical in shape. The inner end housing 18 includes an inner cavity 22 extending axially therein from one or a first axial end thereof. The inner end housing 18 includes an aperture 24 extending axially from another or second axial end and communicating with the cavity 22. The inner end housing 18 includes a plurality of internal threads 26 disposed about the aperture 24. The inner end housing 18 also includes a reduced diameter portion 28 at another or second axial end thereof. The inner end housing 18 includes a plurality of external threads 30 disposed about the reduced diameter portion 28. The inner end housing 18 is made of a suitable material such as metal. It should be appreciated that the inner end housing 18 is removably coupled to the gun in a manner to be described.

Figure 6:
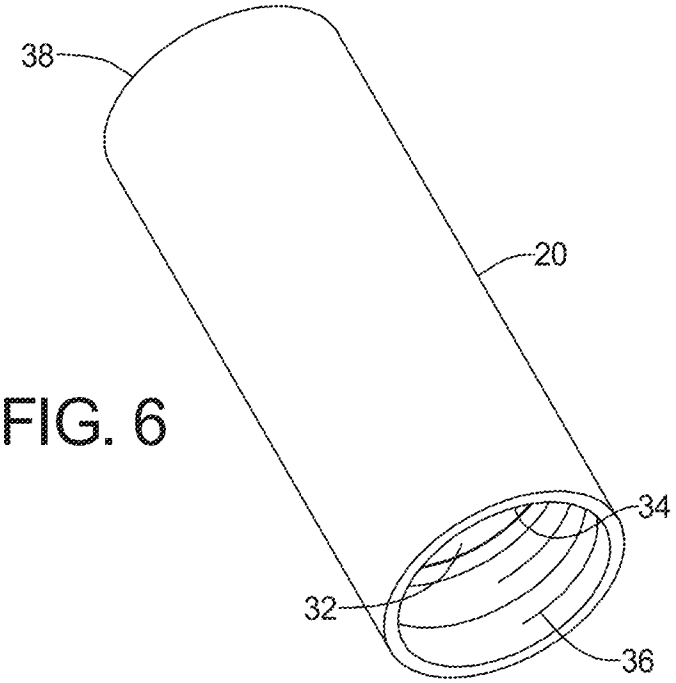
FIG. 6 is a perspective view of an outer end housing of the silencer of FIG. 2.
Figure 7:
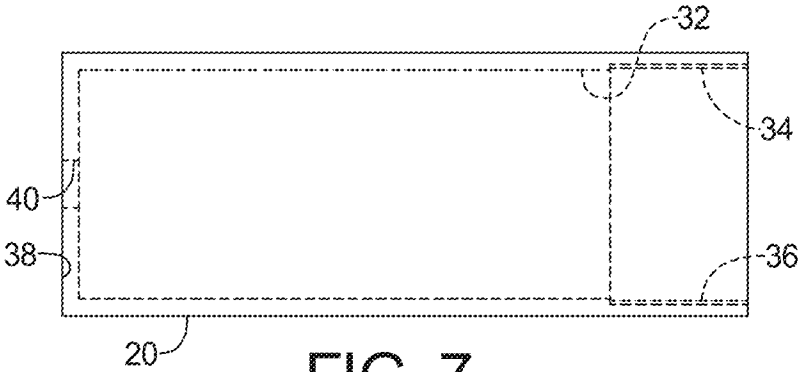
FIG. 7 is a front view of the outer end housing of FIG. 6.
Figure 8:
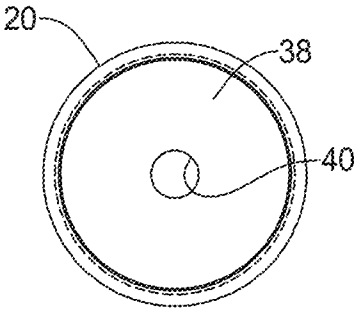
FIG. 8 is an end view of the outer end housing of FIG. 6.

Referring to FIGS. 6-8, the outer end housing 20 is generally cylindrical in shape. The outer end housing 20 includes an inner cavity 32 extending axially therein from one or a first axial end thereof. The outer end housing 20 includes an enlarged aperture 34 extending axially from the first axial end and communicating with the cavity 32. The outer end housing 20 includes a plurality of internal threads 36 disposed about the aperture 34. The outer end housing 20 includes a closed end wall 38 at another or second axial end thereof with an aperture 40 extending axially therethrough. The outer end housing 20 is made of a suitable material such as metal. It should be appreciated that the outer end housing 20 is removably coupled to the inner end housing 18 by a threaded connection of the threads 30 and 36.

Figure 9:
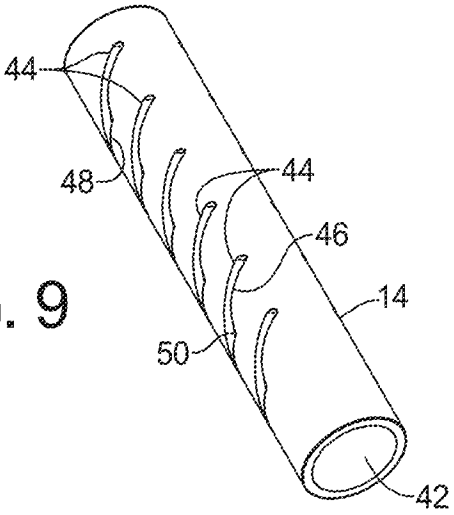
FIG. 9 is a perspective view of a baffle holder of the silencer of FIG. 2.
Figure 10:
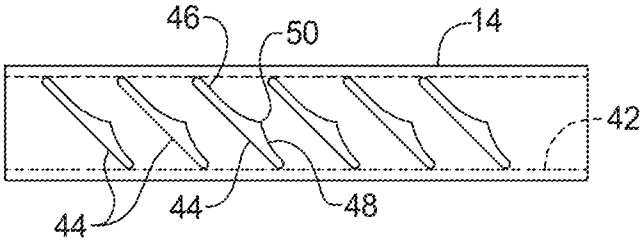
FIG. 10 is a front view of the baffle holder of FIG. 9.
Figure 11:
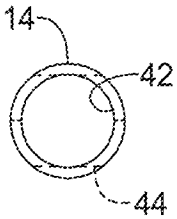
FIG. 11 is an end view of the baffle holder of FIG. 9.

Referring to FIGS. 9-11, the baffle holder 14 is generally cylindrical in shape and extends axially. The baffle holder 14 is tubular and includes an aperture 42 extending axially therethrough such that ends of the baffle holder 14 are open. The baffle holder 14 also includes at least two slots 44 extending radially therein and axially and circumferentially therealong. In one embodiment, the baffle holder 14 includes six slots 44 although more slots 44 can be used. Each of the slots 44 are oriented in the baffle holder 14 at an angle to the axial axis. Each of the slots 44 has a first portion 46 and a second portion 48. The first portion 46 is generally arcuate in shape and the second portion 48 is generally arcuate in shape different from the first portion 46. Each of the slots 44 includes a projection 50 extending outwardly and formed at a juncture of the first portion 46 and the second portion 48. The baffle holder 14 is made of a metal material. It should be appreciated that the baffle holder 14 may be removed from the housing 12 for cleaning.

Figure 12:
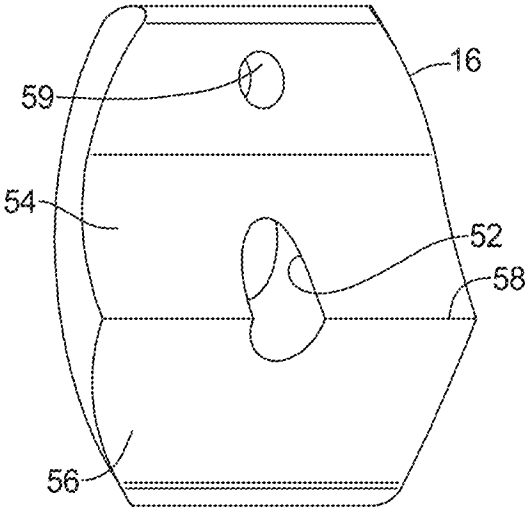
FIG. 12 is a perspective view of a baffle of FIG. 2.
Figure 13:
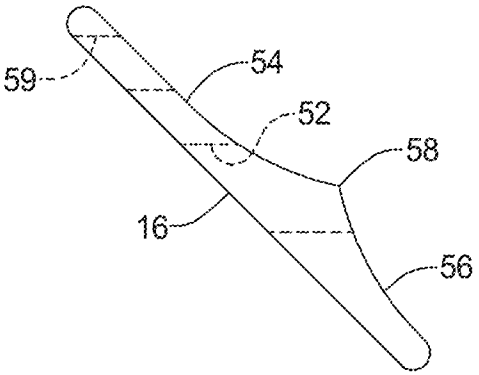
FIG. 13 is a front view of the baffle of FIG. 12.
Figure 14:
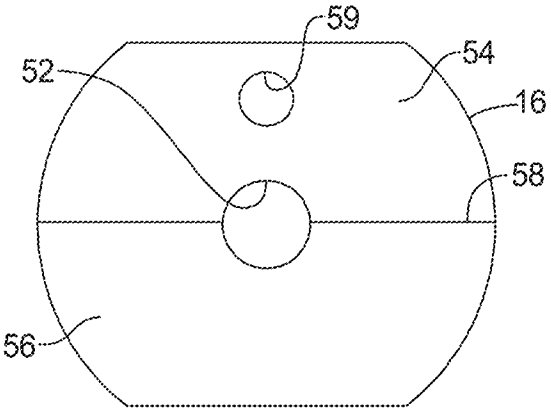
FIG. 14 is an end view of the baffle of FIG. 12.

Referring to FIGS. 12-14, each of the baffles 16 is generally circular in shape and shaped as a disc. Each of the baffles 16 includes an aperture 52 extending axially therethrough. The aperture 52 has a predefined diameter for a particular caliber of bullet. Each of the baffles 16 has a first portion 54 and a second portion 56. The first portion 54 is generally arcuate in shape and the second portion 56 is generally arcuate in shape different from the first portion 54. Each of the baffles 16 includes a projection 58 extending outwardly and formed at a juncture of the first portion 54 and the second portion 56. One of the baffles 16 is disposed in one of the slots 44 of the baffle holder 14 such that the first portion 54 is disposed in the first portion 46 of the slot 44, the second portion 56 is disposed in the second portion 48 of the slot, and the projection 58 is disposed in the projection 50 of the slot 44. In one embodiment, each of the baffles 16 may have another aperture or port 59 extending axially therethrough to allow gases to communicate between each of the baffles 16. The port 59 is spaced radially from the aperture 52 and may be smaller in diameter than the aperture 52. Each of the baffles 16 is made of a metal material. It should be appreciated that the port 59 is optional. It also should be appreciated that the silencer 10 may include sets of baffles 16 with apertures 52 of different calibers that would fit into the slots 44 of the baffle holder 14 in order to be removed and replaced after cleaning.

Figure 16:
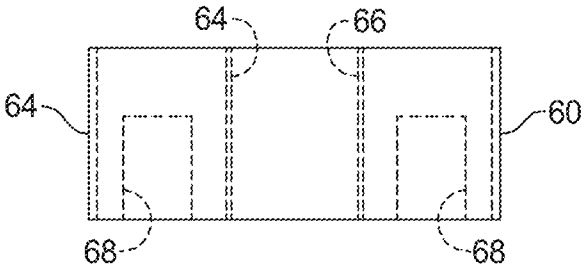
FIG. 16 is a front view of the insert of FIG. 15.
Figure 17:
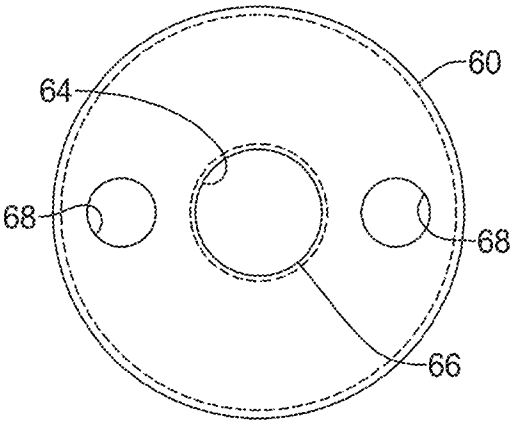
FIG. 17 is an end view of the insert of FIG. 15.
Figure 15:
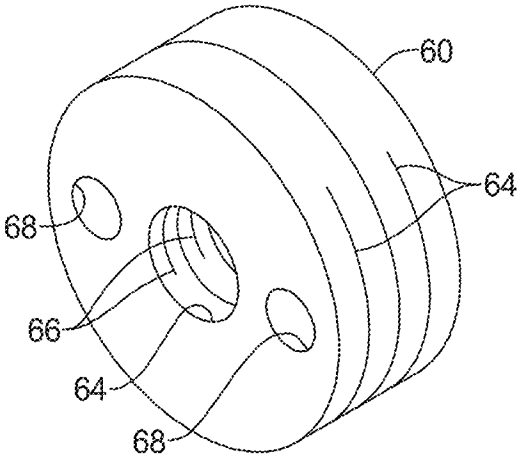
FIG. 15 is a perspective view of an insert of the silencer of FIG. 2.

Referring to FIGS. 15-17, the silencer 10 further includes an insert 60 disposed in one end of the cavity 22 of the inner end housing 18. The insert 60 is generally circular in shape. The insert 60 includes a plurality of external threads 62 to matingly engage the internal threads 26 of the inner end housing 18. The insert 60 has an aperture 64 extending axially therethrough. The insert 60 includes a plurality of internal threads 66 disposed about the aperture 64 to matingly engage threads (not shown) on the gun. The insert 60 also includes a pair of cavities 68 extending axially therein and spaced radially from the aperture 64. The cavities 68 receive a tool (not shown) to allow the insert 60 to be threaded and unthreaded from the inner end housing 18. The insert 60 is made of a suitable material such as metal. It should be appreciated that the insert 60 removably couples the housing 12 to the gun.

The present invention has been described in an illustrative manner. It is to be understood that the terminology, which has been used, is intended to be in the nature of words of description rather than of limitation.

Many modifications and variations of the present invention are possible in light of the above teachings. Therefore, the present invention may be practiced other than as specifically described.

What is claimed is:

1. A silencer for a gun comprising:

an inner end housing adapted to be coupled to a gun;

an outer end housing coupled to said inner end housing and defining an axial axis;

a baffle holder disposed inside said inner end housing and said outer end housing, said baffle holder having at least two slots spaced axially along the axial axis; and at least two baffles disposed in said at least two slots of said baffle holder, one of said at least two baffles being disposed in one of said at least two slots, wherein each of said at least two baffles has an aperture extending axially therethrough to allow a bullet fired from the gun to pass therethrough, wherein each of said at least two slots are oriented in said baffle holder at an angle less than ninety degrees relative to the axial axis of said baffle holder.

2. A silencer as set forth in claim 1 wherein each of said at least two slots has a first portion and a second portion.

3. A silencer for a gun comprising:

an inner end housing adapted to be coupled to a gun;

an outer end housing coupled to said inner end housing and defining an axial axis;

a baffle holder disposed inside said inner end housing and said outer end housing, said baffle holder having at least two slots spaced axially along the axial axis;

at least two baffles disposed in said at least two slots of said baffle holder, one of said at least two baffles being disposed in one of said at least two slots, wherein each of said at least two baffles has an aperture extending axially therethrough to allow a bullet fired from the gun to pass therethrough;

wherein each of said at least two slots has a first portion and a second portion; and wherein said first portion is arcuate in shape and said second portion is arcuate in shape different from said first portion.

4. A silencer as set forth in claim 3 wherein a juncture of said first portion and said second portion defines a projection extending outwardly.

5. A silencer as set forth in claim 1 wherein each of said at least two baffles has a first portion and a second portion.

6. A silencer as set forth in claim 5 wherein said first portion is arcuate in shape and said second portion is arcuate in shape different from said first portion.

7. A silencer as set forth in claim 6 wherein a juncture of said first portion and said second portion defines a projection extending outwardly, said aperture extending axially through said projection.

8. A silencer for a gun comprising:

an inner end housing adapted to be coupled to a gun;

an outer end housing coupled to said inner end housing and defining an axial axis;

a baffle holder disposed inside said inner end housing and said outer end housing, said baffle holder having at least two slots spaced axially along the axial axis;

at least two baffles disposed in said at least two slots of said baffle holder, one of said at least two baffles being disposed in one of said at least two slots, wherein each of said at least two baffles has an aperture extending axially therethrough to allow a bullet fired from the gun to pass therethrough; and wherein each of said at least two baffles includes a port radially spaced from said aperture and the axial axis and extending axially therethrough.

9. A silencer as set forth in claim 1 wherein said inner end housing and said outer end housing are removably connected together.

10. A silencer as set forth in claim 9 wherein said inner end housing includes a plurality of external threads on one end thereof.

11. A silencer as set forth in claim 10 wherein said outer end housing includes a plurality of internal threads on one end thereof to matingly engage said external threads.

12. A silencer as set forth in claim 1 wherein said inner end housing includes a plurality of internal threads on another end thereof.

13. A silencer for a gun comprising:

an inner end housing adapted to be coupled to a gun;

an outer end housing coupled to said inner end housing and defining an axial axis;

a baffle holder disposed inside said inner end housing and said outer end housing, said baffle holder having at least two slots spaced axially along the axial axis;

at least two baffles disposed in said at least two slots of said baffle holder, one of said at least two baffles being disposed in one of said at least two slots, wherein each of said at least two baffles has an aperture extending axially therethrough to allow a bullet fired from the gun to pass therethrough;

wherein said inner end housing has a cavity and includes a plurality of internal threads on another end thereof; and an insert disposed in one end of the cavity of said inner end housing and having a plurality of external threads to matingly engage said internal threads of said inner end housing wherein said insert has an aperture extending axially therethrough and includes a plurality of internal threads disposed about said aperture to matingly engage threads on the gun.

14. A silencer as set forth in claim 13 wherein said insert has an aperture extending axially therethrough.

15. A silencer for a gun comprising:

an inner end housing adapted to be coupled to a gun;

an outer end housing removably connected to said inner end housing and defining an axial axis;

a baffle holder disposed inside said inner end housing and said outer end housing, said baffle holder having at least two slots spaced axially along the axial axis and oriented in said baffle holder at an angle to the axial axis; and at least two baffles disposed in said at least two slots of said baffle holder, one of said at least two baffles being disposed in one of said at least two slots, said at least two baffles having a first portion and a second portion, wherein a juncture of said first portion and said second portion defines a projection extending outwardly at an angle greater than zero degrees relative to the axial axis, said projection including an aperture extending axially therethrough along the axial axis to allow a bullet fired from the gun to pass therethrough.

16. A silencer as set forth in claim 15 wherein said inner end housing includes a plurality of external threads on one end thereof and said outer end housing includes a plurality of internal threads on one end thereof to matingly engage said external threads.

17. A silencer as set forth in claim 15 wherein said inner end housing includes a plurality of internal threads on another end thereof.

18. A silencer as set forth in claim 17 including an insert having a plurality of external threads to matingly engage said internal threads of said inner end housing and an aperture extending axially therethrough.

19. A silencer for a gun comprising:

an inner end housing adapted to be coupled to a gun;

an outer end housing removably connected to said inner end housing and defining an axial axis, wherein said inner end housing includes a plurality of external threads on one end thereof, said outer end housing includes a plurality of internal threads on one end thereof to matingly engage said external threads, said inner end housing including a plurality of internal threads on another end thereof;

an insert having a plurality of external threads to matingly engage said internal threads of said inner end housing and an aperture extending axially therethrough;

a baffle holder disposed inside said inner end housing and said outer end housing, said baffle holder having at least two slots spaced axially along the axial axis and oriented in said baffle holder at an angle to the axial axis, wherein each of said at least two slots has a first portion and a second portion forming a first projection; and at least two baffles disposed in said at least two slots of said baffle holder, one of said at least two baffles being disposed in one of said at least two slots, said at least two baffles having a third portion and a fourth portion, wherein a juncture of said third portion and said fourth portion defines a second projection extending outwardly, said projection including an aperture extending axially therethrough to allow a bullet fired from the gun to pass therethrough, wherein said third portion is disposed in said first portion, said fourth portion is disposed in said second portion, and said second projection is disposed in said first projection.

* * * * *